US011631525B2

(12) United States Patent
Yoshino et al.

(10) Patent No.: US 11,631,525 B2
(45) Date of Patent: Apr. 18, 2023

(54) COIL COMPONENT

(71) Applicant: TDK CORPORATION, Tokyo (JP)

(72) Inventors: Hanako Yoshino, Tokyo (JP); Hiroshi Suzuki, Tokyo (JP); Daisuke Urabe, Tokyo (JP); Keigo Higashida, Tsuruoka (JP); Tomokazu Tsuchiya, Tokyo (JP)

(73) Assignee: TDK CORPORATION, Tokyo (JP)

( * ) Notice: Subject to any disclaimer, the term of this patent is extended or adjusted under 35 U.S.C. 154(b) by 530 days.

(21) Appl. No.: 16/751,579

(22) Filed: Jan. 24, 2020

(65) Prior Publication Data

US 2020/0243257 A1 Jul. 30, 2020

(30) Foreign Application Priority Data

Jan. 28, 2019 (JP) ..... JP2019-012473

(51) Int. Cl.
*H01F 27/28* (2006.01)
*H01F 27/00* (2006.01)
*H01F 27/29* (2006.01)

(52) U.S. Cl.
CPC ..... *H01F 27/2823* (2013.01); *H01F 27/006* (2013.01); *H01F 27/29* (2013.01)

(58) Field of Classification Search
CPC .... H01F 41/06; H01F 27/006; H01F 27/2823; H01F 27/29; H01F 5/04; H01F 17/045; H01F 27/306
See application file for complete search history.

(56) References Cited

U.S. PATENT DOCUMENTS 3,886,434 A * 5/1975 Schreiner ..... H01F 38/42 315/411
5,305,961 A * 4/1994 Errard ..... H01F 27/2823 29/605
6,069,549 A * 5/2000 Heritier-Best ..... H01F 5/02 336/190
2016/0118184 A1* 4/2016 Ukai ..... H01F 17/045 336/192
2017/0263372 A1* 9/2017 Ashizawa ..... H01F 27/006
2018/0182528 A1* 6/2018 Miyamoto ..... H01F 27/292
2019/0043650 A1* 2/2019 Tamura ..... H01F 17/045
2019/0237243 A1* 8/2019 Chuang ..... H01F 27/29

FOREIGN PATENT DOCUMENTS

JP 2005044858 A 2/2005
JP 2018107248 A 7/2018

* cited by examiner

*Primary Examiner* — Mang Tin Bik Lian
(74) *Attorney, Agent, or Firm* — Young Law Firm, P.C.

(57) ABSTRACT

Disclosed herein is a coil component that includes a winding core part and a wire wound around the winding core part. An i-th turn (i is an integer equal to or larger than 1) to a j-th turn (j is an integer equal to or larger than (i+2)) of the wire are wound in this order around the winding core part in an aligned state. A (j-th+1) turn of the wire is wound around a valley line formed by the i-th turn and a (i-th+1) turn. A (j-th+2) turn of the wire is wound adjacent to the j-th turn around the winding core part.

14 Claims, 12 Drawing Sheets

COIL COMPONENT

BACKGROUND OF THE INVENTION

Field of the Invention

The present invention relates to a coil component and, more particularly to a coil component in which a wire is wound around a winding core part thereof in multiple layers.

Description of Related Art

To increase the inductance of a coil component in which a wire is wound around a winding core part thereof, it is necessary to increase the number of turns of the wire. However, when the wire is wound around a winding core part in a single layer, the length necessary for the winding core part is increased in proportion to the number of turns. Thus, in order to increase the number of turns of the wire while suppressing an increase in the length of the winding core part, the wire needs to be wound around the winding core part in multiple layers as described in JP 2005-44858A and JP 2018-107248A.

Meanwhile, the coil component mainly used in a power supply circuit is required to provide low DC resistance and high rated current. In order to satisfy the requirements, a wire large in diameter should preferably be used.

However, a wire having a large wire diameter is hard to bend, so that the wire needs to be wound with a comparatively strong force at the time of winding work. Thus, when the wire is wound around the winding core part in multiple layers, the lower layer wire may be moved due to a force applied during winding of the upper layer wire to cause the wire to be wound in the upper layer to drop to the lower layer. For example, when the winding structure described in JP 2005-44858A (FIG. 3) is attempted to be obtained, the third turn may drop between the first turn and the second turn and, when the winding structure described in JP 2005-44858A (FIG. 4) is attempted to be obtained, the fifth turn may drop between the second turn and the third turn. Similarly, when the winding structure described in JP 2018-107248A (FIG. 1) is attempted to be obtained, the fifth turn may drop between the second turn and the third turn.

SUMMARY

It is therefore an object of the present invention to provide a coil component having a winding structure in which a wire to be wound in the upper layer is hard to drop to the lower layer even when the wire has a large wire diameter.

A coil component according to the present invention includes a winding core part and a wire configured such that wire turns thereof from i-th turn (i is an integer equal to or larger than 1) to j-th turn (j is an integer equal to or larger than (i+2)) are wound in this order around the winding core part in an aligned state, that (j-th+1) turn is wound around a valley line formed by i-th turn and (i-th+1) turn, and that (j-th+2) turn is wound adjacent to the j-th turn around the winding core part.

According to the present invention, (j-th+1) turn wound in an upper layer is supported by at least three wire turns positioned in a lower layer, so that even when a wire having a large wire diameter is used, dropout of the wire becomes less apt to occur.

In the present invention, the wire turns from (j-th+2) turn to (j-th+2k) turn (k is a variable starting from 2 and incremented by one) may be wound in this order around the winding core part in an aligned state. Thus, a winding structure in which even-number turns or odd-number turns are wound in the lower layer can be obtained.

In the present invention, (j-th+3) turn may be wound along a valley line formed by (j-th−1) turn and j-th turn. Thus, (j-th+3) turn wound in the upper layer can be supported by at least three wire turns positioned in the lower layer. In addition, a difference in turn number between adjacent turns is small, so that a parasitic capacitance component can be reduced.

In this case, (j-th+2k+1) turn may be wound along a valley line formed by (j-th+2k−4) turn and (j-th+2k−2) turn. Thus, (j-th+2k+1) turn wound in the upper layer can be supported by three wire turns positioned in the lower layer.

In the present invention, (j-th+3) turn may be wound along a valley line formed by (j-th−2) turn and (j-th−1) turn. Thus, (j-th+3) turn poisoned in the upper layer can be supported by at least four wire turns positioned in the lower layer, thus making it possible to prevent dropout of the wire more effectively.

In this case, (j-th+2k+3) turn may be wound along a valley line formed by the (j-th+2k−4) turn and (j-th+2k−2) turn. Thus, (j-th+2k+3) turn wound in the upper layer can be supported by at least four wire turns positioned in the lower layer.

Further, in this case, any of (j-th+2k+3) turns may not be wound along a valley line formed by (j-th+2p) turn (p is an integer equal to or larger than 2) and (j-th+2p+2) turn. Thus, a difference in turn number between adjacent turns is small, so that a parasitic capacitance component can be reduced.

The coil component according to the present invention may further include a flange part and a terminal electrode provided on the flange part and connected with one end of the wire. The i-th turn may be the 1st turn with the terminal electrode as a winding start point. Thus, when the j-th turn is the 3rd or 4th turn, the 4th turn or 5th turn wound in an upper layer can be prevented from dropping.

As described above, the coil component according to the present invention has a winding structure in which a wire to be wound in the upper layer is hard to drop to the lower layer, allowing a wire having a large wire diameter to be used, whereby a low DC resistance and a high rated current can be achieved.

BRIEF DESCRIPTION OF THE DRAWINGS

The above features and advantages of the present invention will be more apparent from the following description of certain preferred embodiments taken in conjunction with the accompanying drawings, in which.

DETAILED DESCRIPTION OF THE EMBODIMENTS

Preferred embodiments of the present invention will be explained below in detail with reference to the accompanying drawings.

Figure 1:
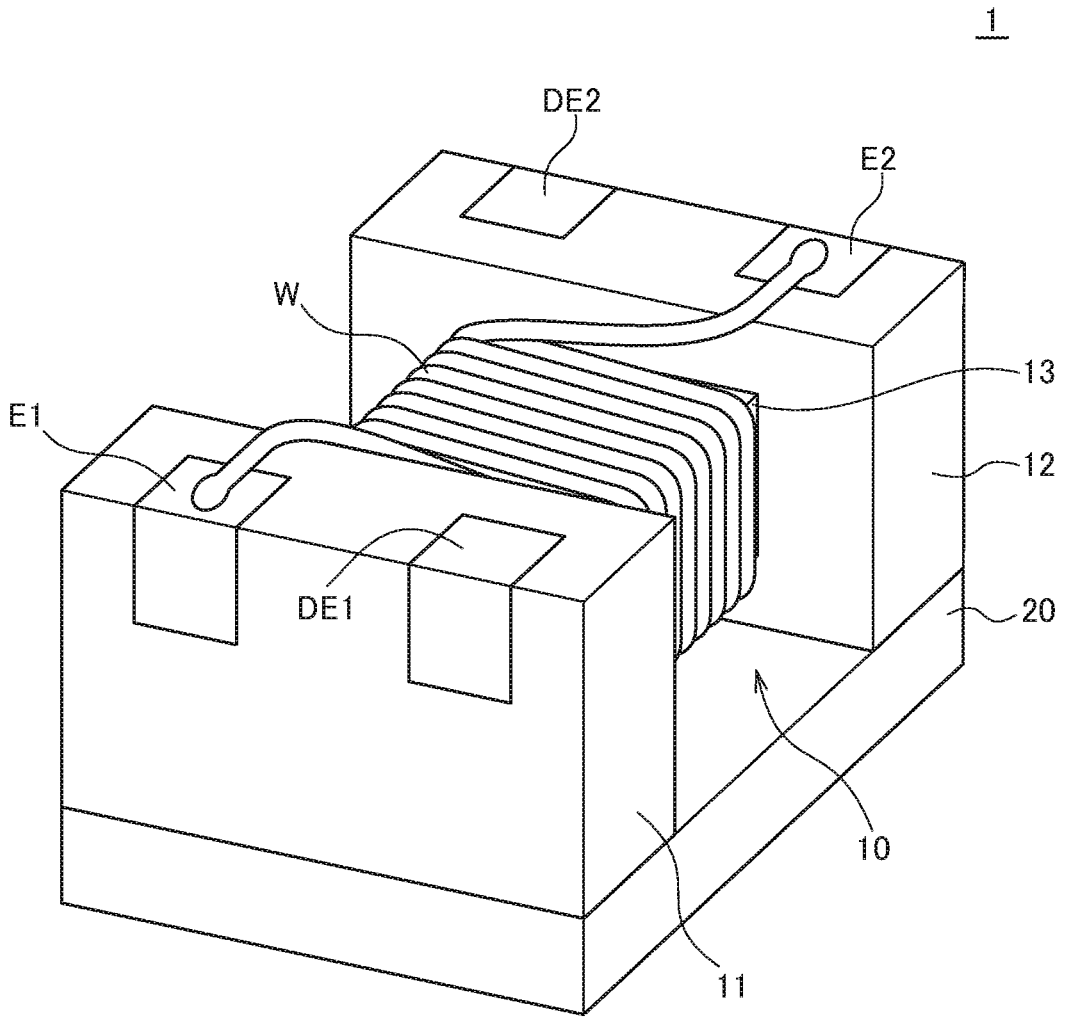
FIG. 1 is a schematic perspective view illustrating the outer appearance of a coil component according to a preferred embodiment of the present invention.

FIG. 1 is a schematic perspective view illustrating the outer appearance of a coil component 1 according to a preferred embodiment of the present invention.

As illustrated in FIG. 1, the coil component 1 according to the present embodiment includes a drum-shaped core 10 having flange parts 11 and 12 and a winding core part 13, a plate-shaped core 20 fixed to the flange parts 11 and 12, a terminal electrode E1 and a dummy terminal electrode DE1 which are provided on the flange part 11, a terminal electrode E2 and a dummy terminal electrode DE2 which are provided on the flange part 12, and a wire W wound around the winding core part 13. The wire W is a coated conductive wire with a good conductor such as copper as a core material.

The core 10 is a drum-shaped block made of a high-permeability material such as ferrite and has a structure integrating the flange parts 11, 12 and the winding core part 13 provided therebetween. The core 20 is a plate-shaped block also made of a high-permeability material such as ferrite. The cores 10 and 20 are fixed to each other by an adhesive. One end of the wire W is connected to the terminal electrode E1, and the other end thereof is connected to the terminal electrode E2. The dummy terminal electrodes DE1 and DE2 are not connected with the wire W. The terminal electrodes E1, E2 and dummy terminal electrodes DE1, DE2 are each formed of, e.g., silver paste fired on the core 10. The dummy terminal electrodes DE1 and DE2 are connected to a land pattern (or a dummy land pattern) on a printed circuit board through a solder when the coil component 1 is mounted on the printed circuit board so as to increase the mounting strength of the coil component 1. However, in the present invention, such dummy terminal electrodes DE1 and DE2 are not essential.

In place of the terminal electrodes E1 and E2, a terminal fitting may be used. For example, as in a coil component 2 according to a modification illustrated in FIG. 2, a terminal fitting 30 fixed to the flange part 11 and a terminal fitting 40 fixed to the flange part 12 may be used. The terminal fitting 30 is a terminal electrode fixed to the flange part 11 of the core 10 by an adhesive and is connected with one end of the wire W, and the terminal fitting 40 is a terminal electrode fixed to the flange part 12 of the core 10 by an adhesive and is connected with the other end of the wire W.

Figure 2:
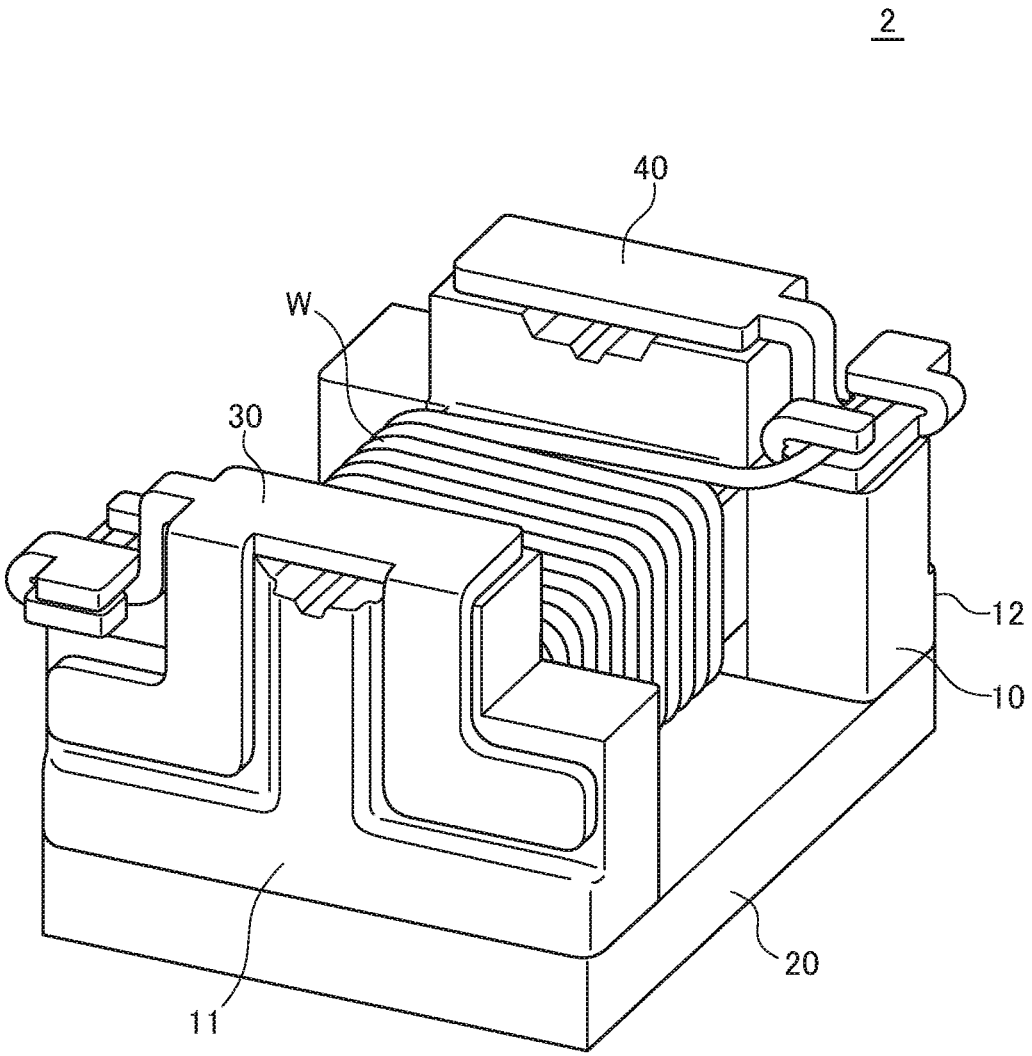
FIG. 2 is a schematic perspective view illustrating the outer appearance of a coil component according to a modification.
Figure 3:
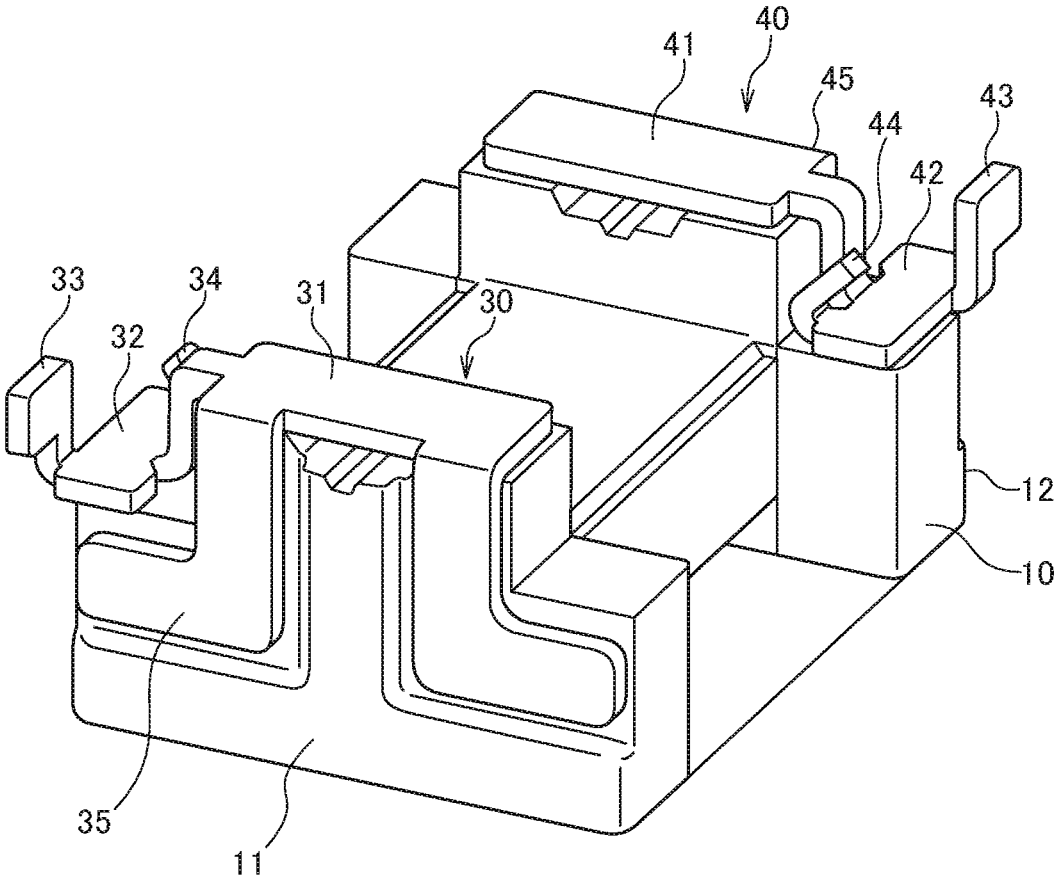
FIG. 3 is a schematic perspective view illustrating a state before the wire is wound around the winding core part.

In the manufacturing of the coil component 2, first, the terminal fittings 30 and 40 are bonded to the core 10, and then one end of the wire W is connected to the terminal fitting 30. As illustrated in FIG. 3, the terminal fitting 30 in a state before wire connection has a mounting part 31, a wire connection part 32, a welding tab 33, a fixing tab 34, and a fillet formation part 35. In a state where one end of the wire W is disposed on the wire connection part 32, the fixing tab 34 is folded to thereby secure the one end of the wire W to the wire connection part 32. In this state, the welding tab 33 is folded and melted by heat, whereby the terminal fitting 30 and the one end of the wire W are welded. Thereafter, the core 10 is rotated to wind the wire W around the winding core part 13. Similarly, the terminal fitting 40 in a state before wire connection has a mounting part 41, a wire connection part 42, a welding tab 43, a fixing tab 44 and a fillet formation part 45. In a state where the other end of the wire W wound around the winding core part 13 is disposed on the wire connection part 42, the fixing tab 44 is folded to thereby secure the other end of the wire W to the wire connection part 42. In this state, the welding tab 43 is folded and melted by heat, whereby the terminal fitting 40 and the other end of the wire W are welded. Finally, the core 20 is bonded to the core 10, whereby the coil component 2 illustrated in FIG. 2 is completed.

In the coil component 2 in actual use, the land pattern on the printed circuit board and the mounting parts 31 and 41 of the terminal fittings 30 and 40 are connected through a solder. At this time, the solder reaches the fillet formation parts 35 and 45 by surface tension to forma solder fillet.

In the present embodiment, one wire W is wound around the winding core part 13 of the core 10 in a plurality of turns. Although not particularly limited, the coil component 1 or coil component 2 according to the present embodiment is a coil component for a power supply circuit and is thus required to have a low DC resistance and a high rated current, so that a wire W having a large wire diameter is used therein.

The following describes in detail the winding structure of the wire W.

Figure 4:
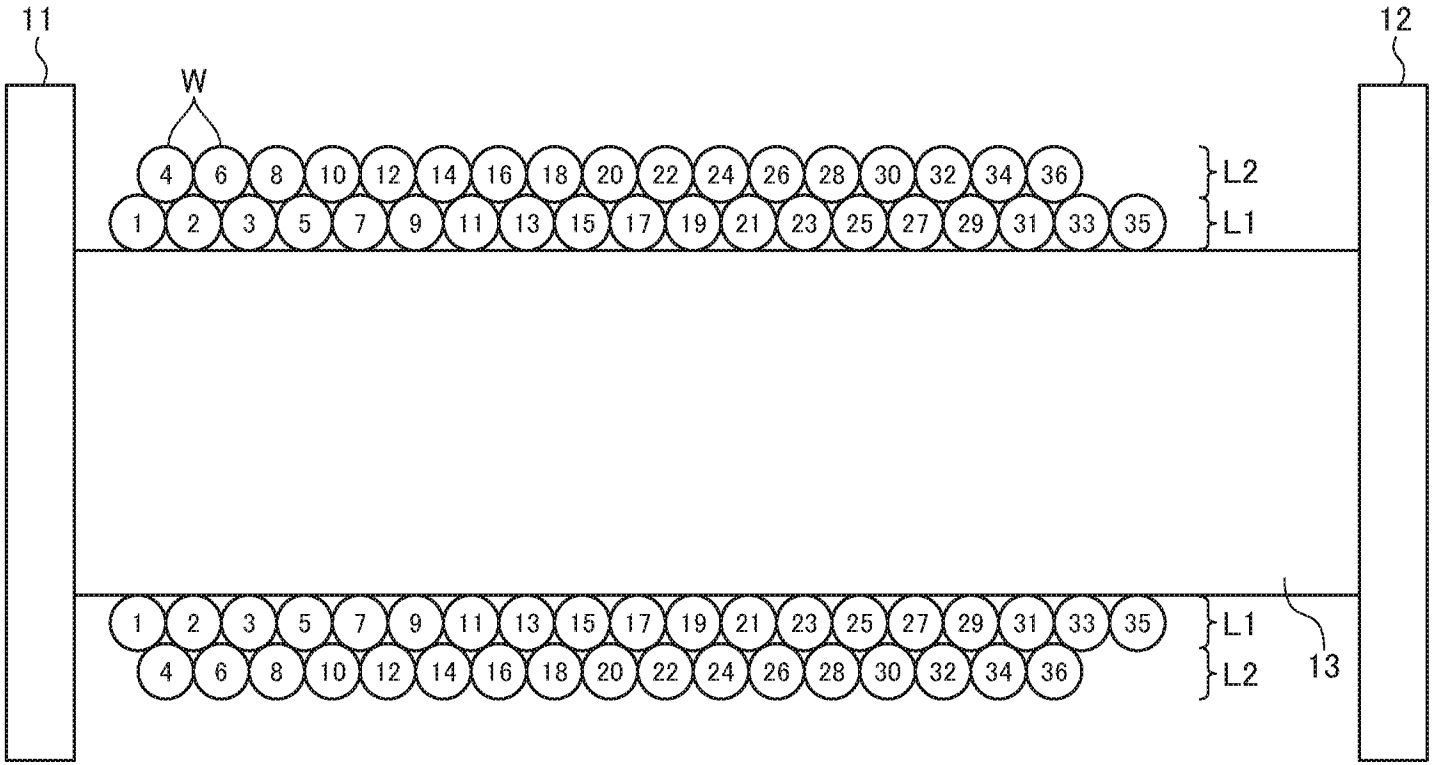
FIG. 4 is a schematic cross-sectional view for explaining a first winding structure of the wire.

FIG. 4 is a schematic cross-sectional view for explaining a first winding structure of the wire W.

The number assigned to the wire W in FIG. 4 indicates the number of turns with the terminal electrode E1 or metal fitting 30 as a winding starting point. The same applies in FIGS. 5 to 12. In the examples described below, the number of turns of the wire W is set to 36, but not limited thereto.

In the first winding structure illustrated in FIG. 4, 1st to 3rd, 5th, 7th, 9th, 11th, 13th, 15th, 17th, 19th, 21st, 23rd, 25th, 27th, 29th, 31st, 33rd and 35th turns of the wire W constitute a winding layer L1 as a lower layer (hereinafter, referred to as "lower winding layer L1"), and 4th, 6th, 8th, 10th, 12th, 14th, 16th, 18th, 20th, 22nd, 24th, 26th, 28th, 30th, 32nd, 34th and 36th turns of the wire W constitute a winding layer L2 as an upper layer (hereinafter, referred to as "upper winding layer L2"). The lower winding layer L1 refers to a part of the wire W that is directly wound around the winding core part 13. The upper winding layer L2 refers to a part of the wire W that is wound around the winding core part 13 through the winding layer L1. As described above, in the first winding structure, the odd-numbered turns (with the exception of 2nd turn) constitute the lower winding layer L1, and the even-numbered turns constitute the upper winding layer L2. The turns positioned in the upper winding layer L2, except for 4th and 6th turns, are each wound along a valley line formed by turns positioned in the lower winding layer L1 whose turn numbers are smaller by 5 and 3 therethan.

More generally, assuming that 1st and 3rd turns are i-th and j-th turns, respectively, i-th turn, (i-th+1) turn (=(j-th−1) turn) and j-th turn are wound in this order around the winding core part 13 in an aligned state, (j-th+1) turn is wound along a valley line formed by i-th turn and (i-th+1) turn, and (j-th+2) turn is wound, adjacent to j-th turn, around the winding core part 13. Then, the turns from (j-th+2) turn to (j-th+2k) turn (k is a variable starting from 2 and incremented by one) are wound in this order around the winding core part 13 in an aligned state, (j-th+3) turn is wound along a valley line formed by (j-th−1) turn and j-th turn, and (j-th+2k+1) turn is wound along a valley line formed by (j-th+2k−4) turn and (j-th+2k−2) turn.

Figure 5:
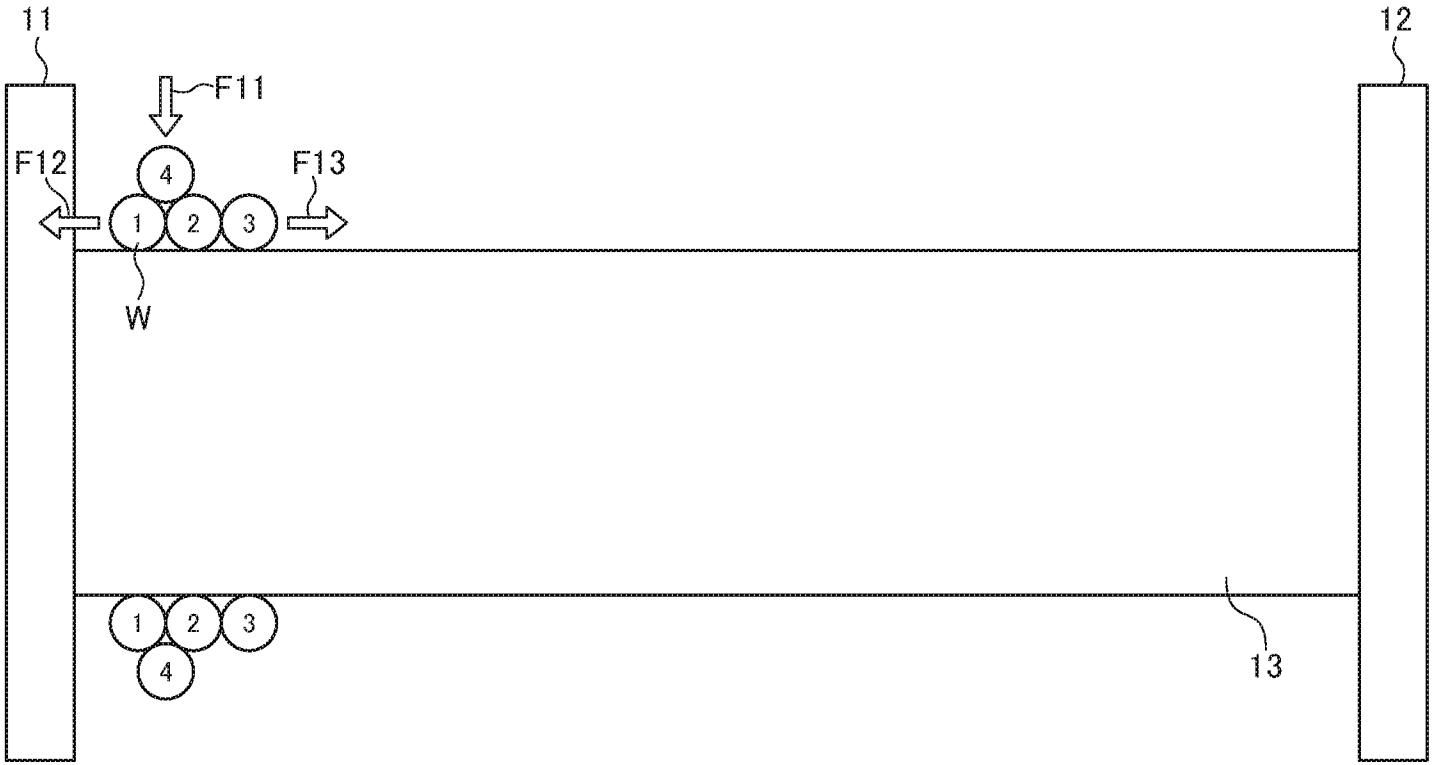
FIG. 5 is a view for explaining a force applied when the 4th turn is wound in the first winding structure.

FIG. 5 is a view for explaining a force applied when the 4th turn is wound in the first winding structure. As illustrated in FIG. 5, when the 4th turn is wound in the first winding structure, a force F11 is applied so as to press the 4th turn against the winding core part 13. At this time, the 4th turn is supported by three turns. The magnitude of the force F11 differs depending on the wire diameter of the wire W. When the wire diameter of the wire W to be used is large, a comparatively large force F11 is required to bend the wire W along the cross-sectional shape of the winding core part 13. The 4th turn is wound along a valley line formed by the 1st and 2nd turns, so that the force F11 is applied to the 1st and 2nd turns. As a result, a force F12 that works to move the 1st turn to the flange part 11 side (left side) acts on the 1st turn, and a force F13 that works to move the 2nd and 3rd turns to the flange part 12 side (right side) acts on the 2nd and 3rd turns.

However, the 1st turn is disposed in proximity to the flange part 11, so that the flange part 11 functions as a stopper. Thus, the force F12 poses essentially no problem. On the other hand, a member functioning as a stopper does not exist to the right of the 3rd turn, so that when the magnitude of the force F13 is large, the 4th turn may drop to the lower winding layer L1. However, in the first winding structure, two turns of the 2nd and 3rd turns have already existed to the right of the 4th turn, so that the static friction force of the two turns can prevent the movement of the 2nd and 3rd turns.

Figure 6:
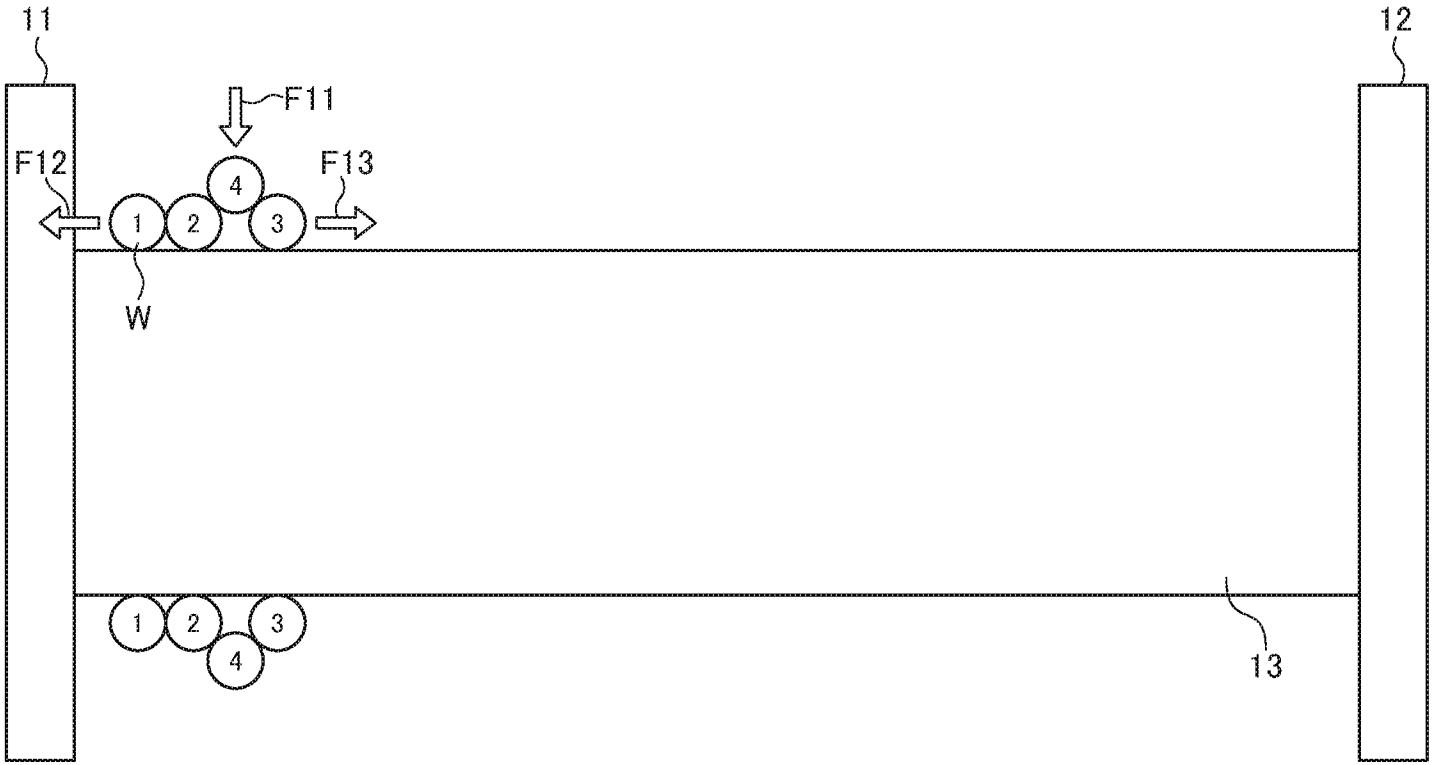
FIG. 6 is a diagram for explaining a problem of the winding structure in a comparative example.

On the other hand, as illustrated in FIG. 6 which is a comparative example, in which when the 4th turn is wound along a valley line formed by the 2nd and 3rd turns, when the magnitude of the force F11 is large, the 3rd turn is easily moved to the right by the force F13, causing the 4th turn to drop. To prevent this, in the first winding structure, the static friction force of the two turns is utilized to prevent the dropout of the upper winding layer L2.

The same applies to when other turns positioned in the upper winding layer L2 are each turned. That is, two turns always exist to the right of a target turn to be wound, making it possible to prevent dropout to the lower winding layer L1. In addition, in the first winding structure, a difference in turn number between the turns vertically contacting each other is suppressed to 5 at maximum, so that an increase of parasitic capacitance component due to proximity between two turns between which a difference in turn number is large can be prevented. That is, a parasitic capacitance component generated by two turns between which a difference in turn number is small is mainly connected in series and is thus reduced in value, while a parasitic capacitance component generated by two turns between which a difference in turn number is large is mainly connected in parallel and thus tends to be increased in value. In the first winding structure, a difference in turn number between the turns vertically contacting each other is suppressed to 5 at maximum, so that an increase in the parasitic capacitance component is suppressed, thus allowing an increase in resonance frequency.

Figure 7:
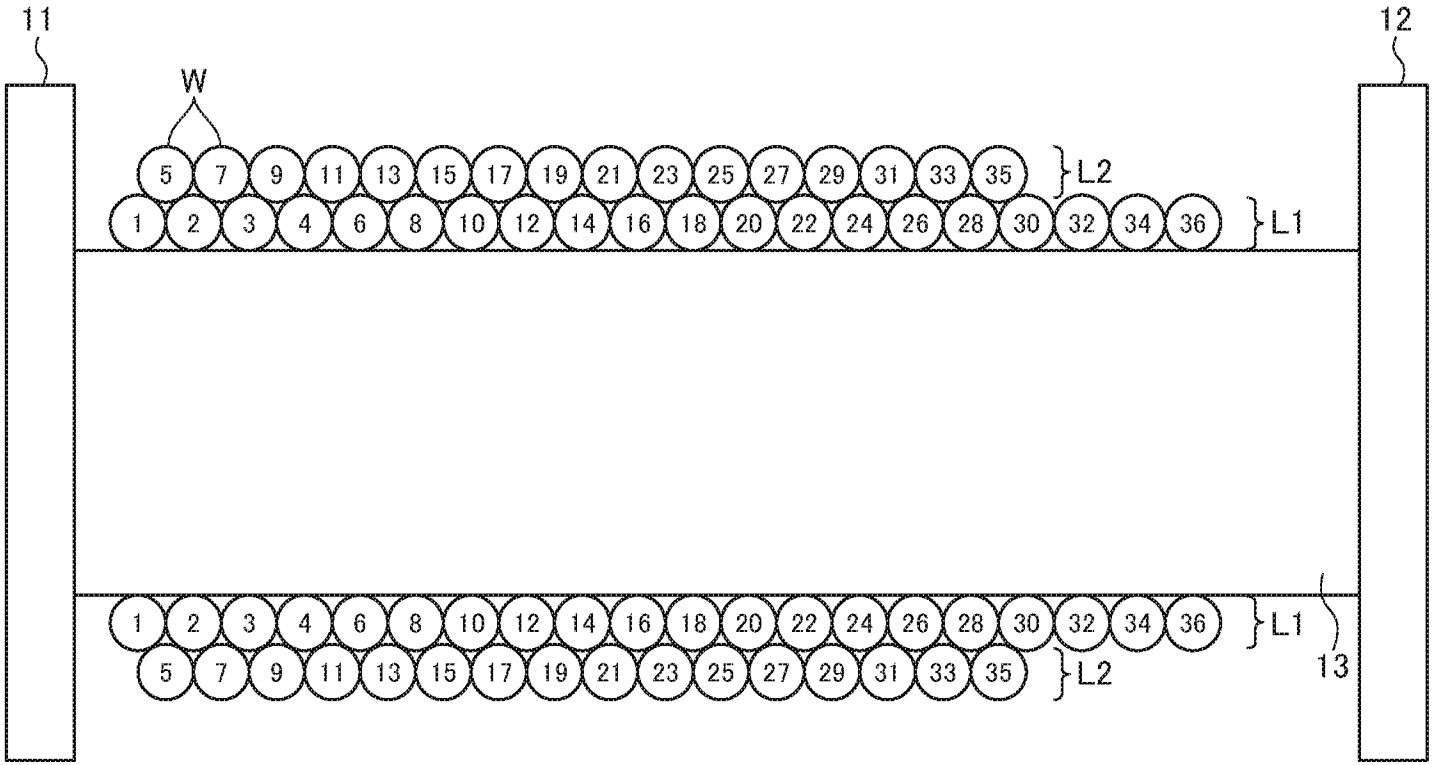
FIG. 7 is a schematic cross-sectional view for explaining a second winding structure of the wire.

FIG. 7 is a schematic cross-sectional view for explaining a second winding structure of the wire W.

In the second winding structure illustrated in FIG. 7, 1st to 4th, 6th, 8th, 10th, 12th, 14th, 16th, 18th, 20th, 22nd, 24th, 26th, 28th, 30th, 32nd, 34th and 36th turns of the wire W constitute the lower winding layer L1, and 5th, 7th, 9th, 11th, 13th, 15th, 17th, 19th, 21st, 23rd, 25th, 27th, 29th, 31st, 33th and 35th turns of the wire W constitute the upper winding layer L2. As described above, in the second winding structure, the even-numbered turns (with the exception of the 1st and 3rd turns) constitute the lower winding layer L1, and the odd-numbered turns constitute the upper winding layer L2. The turns positioned in the upper winding layer L2, except for the 7th and 9th turns, are each wound along a valley line formed by turns positioned in the lower winding layer L1 whose turn numbers are smaller by 7 and 5 therethan.

More generally, assuming that the 1st and 4th turns are i-th and j-th turns, respectively, i-th turn, (i-th+1) turn (=(j-th−2) turn), (i-th+2) turn (=(j-th−1) turn), and j-th turn are wound in this order around the winding core part 13 in an aligned state, (j-th+1) turn is wound along a valley line formed by i-th turn and (i-th+1) turn, (j-th+3) turn is wound along a valley line formed by (j-th−2) turn and (j-th−1) turn, and (j-th+5) turn is wound along a valley line formed by (j-th−1) turn and j-th turn. Then, the turns from (j-th+2) turn to (j-th+2k) turn (k is a variable starting from 2 and incremented by one) are wound in this order around the winding core part 13 in an aligned state, (j-th+2k+3) turn is wound along a valley line formed by the (j-th+2k−4) turn and (j-th+2k−2) turn.

Figure 8:
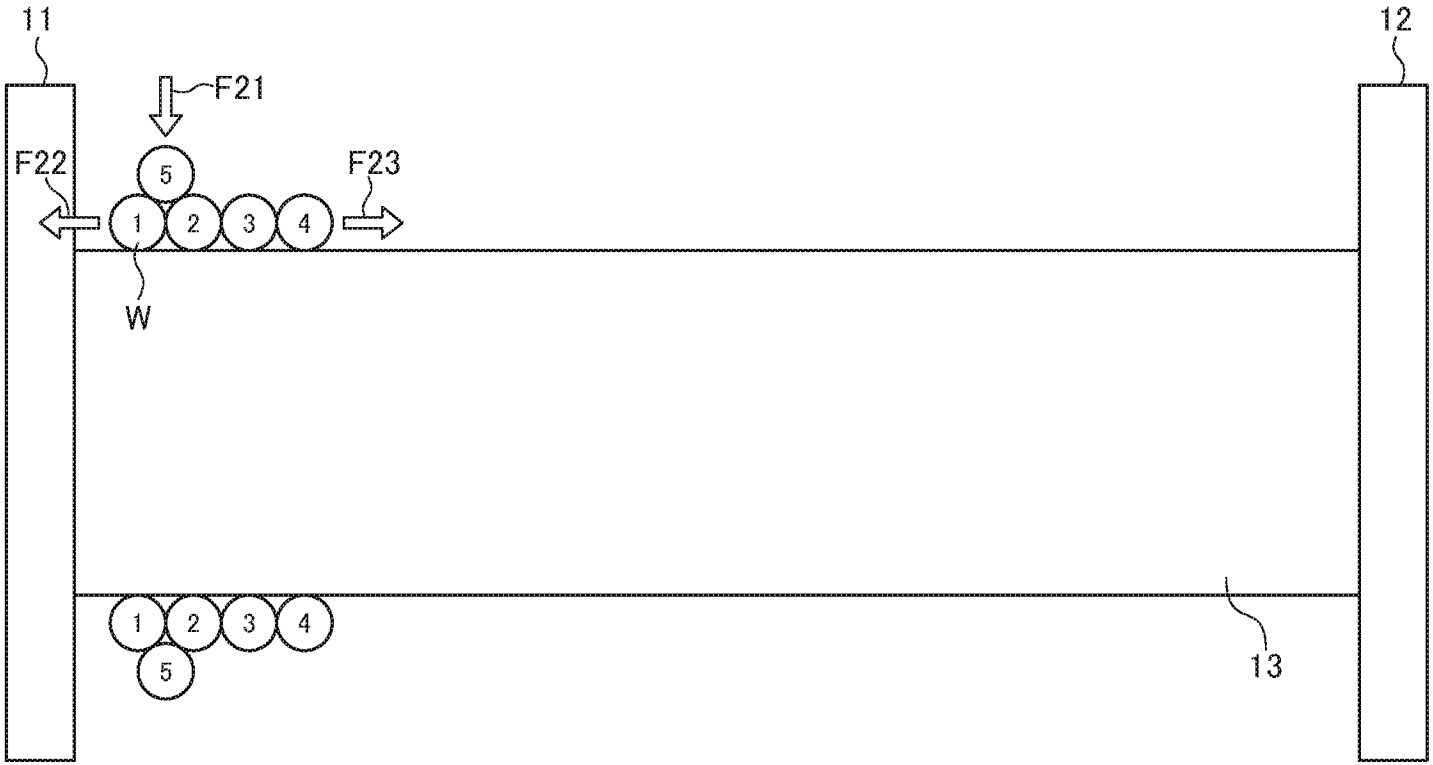
FIG. 8 is a view for explaining a force applied when the 5th turn is wound in the second winding structure.

FIG. 8 is a view for explaining a force applied when the 5th turn is wound in the second winding structure. As illustrated in FIG. 8, when the 5th turn is wound in the second winding structure, a force F21 is applied so as to press the 5th turn against the winding core part 13. At this time, the 5th turn is supported by four turns. As a result, a force F22 that works to move 1st turn to the flange part 11 side (left side) acts on 1st turn, and a force F23 that works to move 2nd to 4th turns to the flange part 12 side (right side) acts on 2nd to 4th turns.

However, like the above-described force F12, the force F22 poses essentially no problem. On the other hand, a member functioning as a stopper does not exist to the right of the 4th turn, so that when the magnitude of the force F23 is large, the 5th turn may drop to the lower winding layer L1. However, in the second winding structure, three turns of 2nd to 4th turns have already existed to the right of the 5th turn, so that the static friction force of the three turns can prevent the movement of 2nd to 4th turns.

The same applies to the case where other turns positioned in the upper winding layer L2 are each turned. That is, three turns always exist to the right of a target turn to be wound, making it possible to prevent dropout to the lower winding layer L1. In addition, in the second winding structure, dropout to the lower winding layer L1 is less likely to occur than in the first winding structure, allowing a wire W having a larger diameter can be used. This can further reduce a DC resistance and further increase a rated current.

Figure 9:
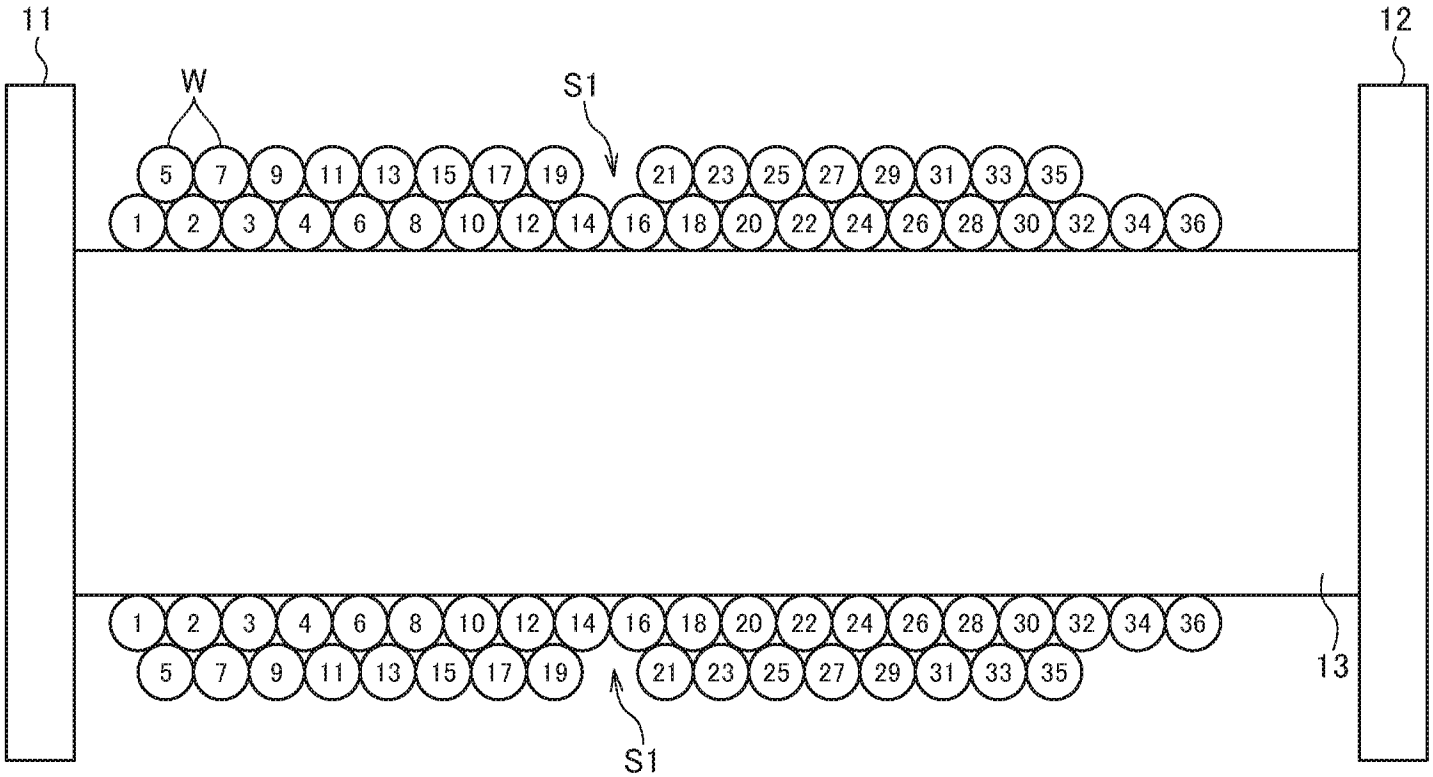
FIG. 9 is a schematic cross-sectional view for explaining a third winding structure of the wire.

FIG. 9 is a schematic cross-sectional view for explaining a third winding structure of the wire W.

The third winding structure illustrated in FIG. 9 differs from the second winding structure illustrated in FIG. 7 in that a space S1 where the wire W does not exist is provided between the 19th and 21st turns. That is, any of turns positioned in the upper winding layer L2 is not wound along a valley line between the 14th and 16th turns. More generally, any of (j-th+2k+3) turns is not wound along a valley line formed by (j-th+2p) turn (p is an integer equal to or larger than 2) and (j-th+2p+2) turn. Thus, in the section of 1st to 20th turns, the winding structure is the same as that of the second winding structure, while in the section of 21st to 36th turns, (j-th+2k+5) turn is wound along a valley line formed by (j-th+2k) turn and (j-th+2k+2) turn.

Figure 10:
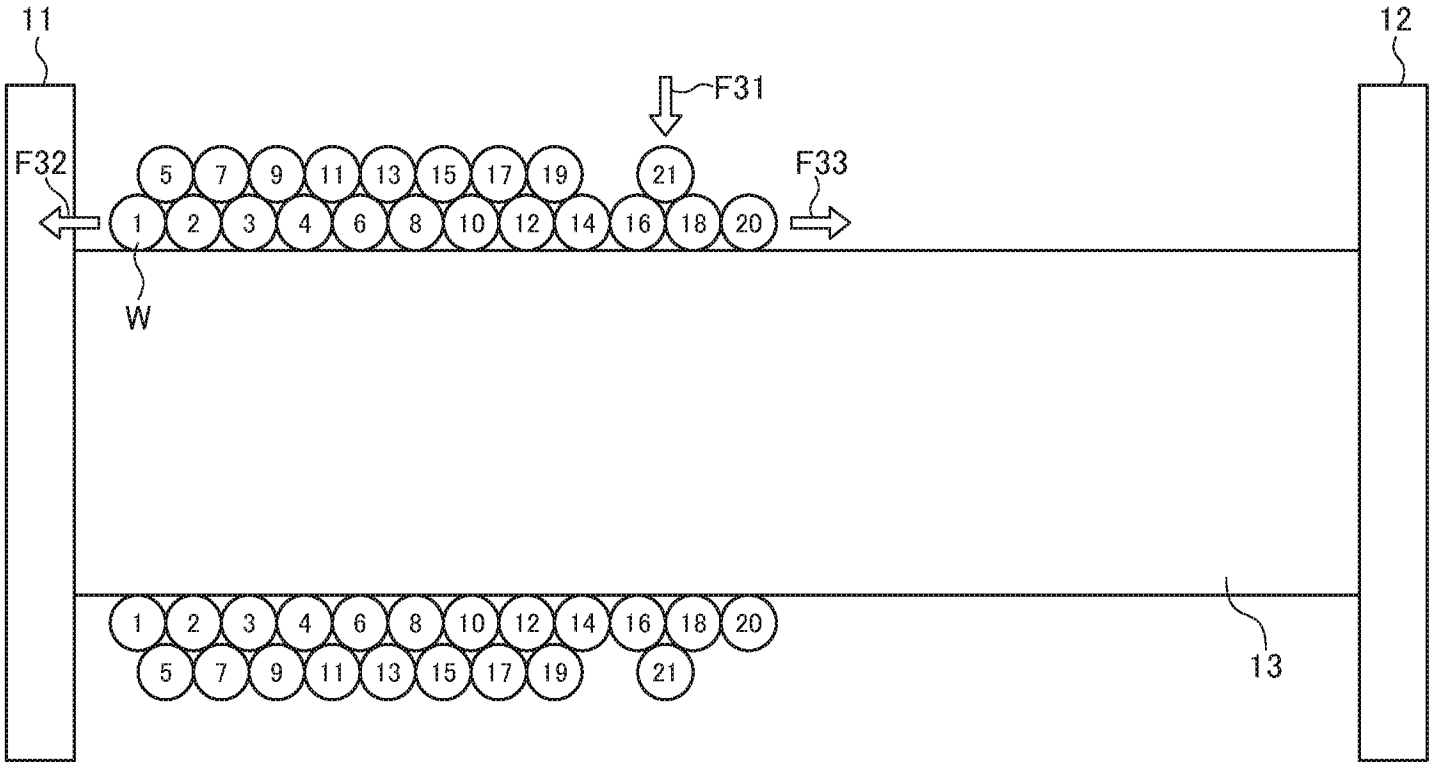
FIG. 10 is a view for explaining a force applied when the 21st turn is wound in the third winding structure.

FIG. 10 is a view for explaining a force applied when the 21st turn is wound in the third winding structure. As illustrated in FIG. 10, when the 21st turn is wound in the third winding structure, a force F31 is applied so as to press the 21st turn against the winding core part 13. A force F32 acting by the force F31 poses no problem at all; however, when the magnitude of a force F33 acting on the 18th and 20th turns is large, the 21st turn may drop to the lower winding layer L1. However, two turns of the 18th and 20th turns have already existed to the right of the 21st turn, so that, as is the case in the first winding structure, the static friction force of the two turns can prevent the movement of the 18th and 20th turns.

Figure 11:
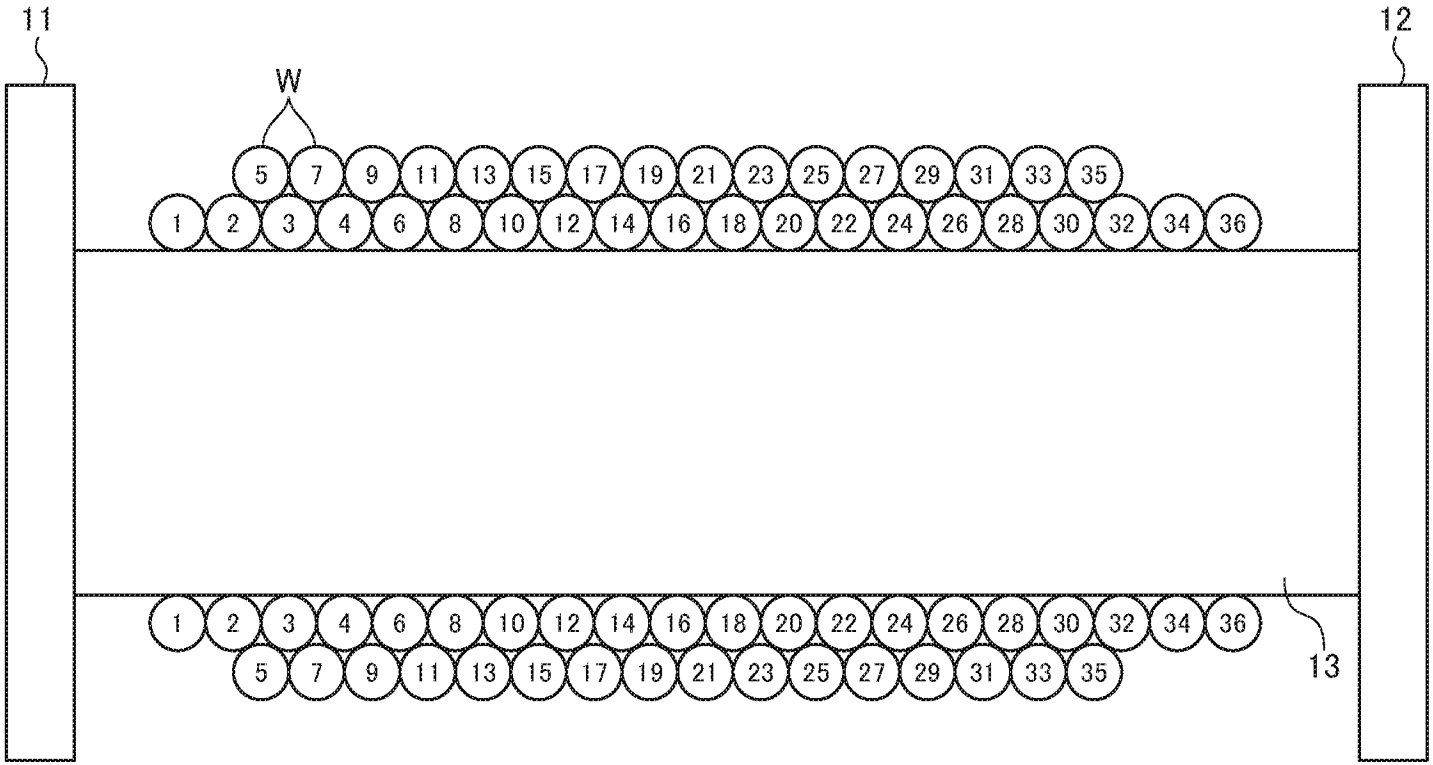
FIG. 11 is a schematic cross-sectional view for explaining a fourth winding structure of the wire.

FIG. 11 is a schematic cross-sectional view for explaining a fourth winding structure of the wire W.

The fourth winding structure illustrated in FIG. 11 is the same as the first winding structure illustrated in FIG. 4 except that the 2nd turn corresponds to the i-th turn. Thus, basically, the same effects as those in the first winding structure can be obtained.

Figure 12:
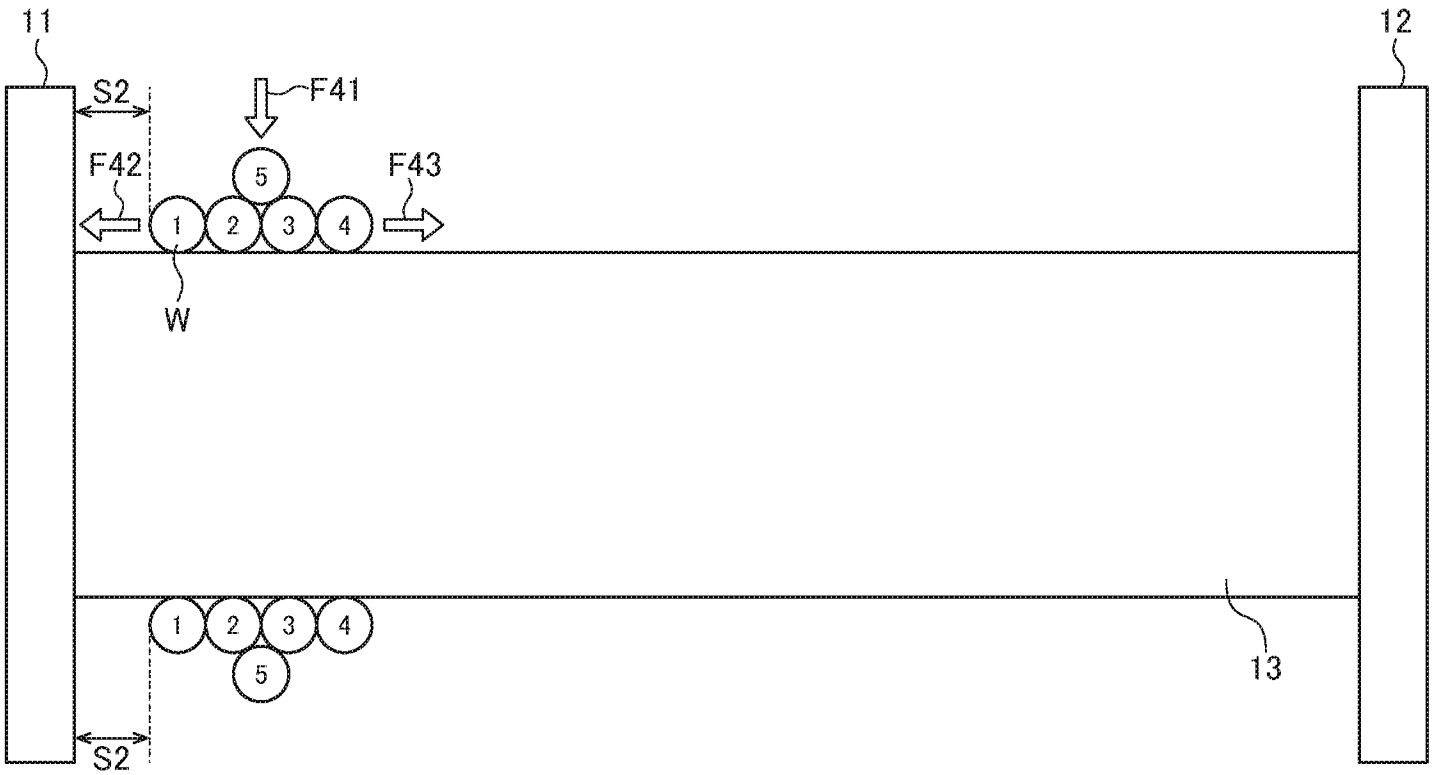
FIG. 12 is a view for explaining a force applied when the 5th turn is wound in the fourth winding structure.

FIG. 12 is a view for explaining a force applied when the 5th turn is wound in the fourth winding structure. As illustrated in FIG. 12, when the 5th turn is wound in the fourth winding structure, a force F41 is applied so as to press the 5th turn against the winding core part 13. As a result, leftward and rightward forces F42 and F43 are generated; however, as described using FIG. 5, the movement by the rightward force F43 is prevented by the static friction force of the 3rd and 4th turns. On the other hand, in the fourth winding structure, two turns exist to the left of the 5th turns as well, so that the movement by the leftward force F42 is prevented by the static friction force of the 1st and 2nd turns. Thus, even when a space S2 between the 1st turn and the flange part 11 is wide, (for example, even when the width of the space S is equal to or larger than the diameter of the wire W, which situation tends to cause the 1st and 2nd turns to move to the left), the leftward movement thereof can be prevented. Thus, the fourth winding structure is effective when the 1st turn, which is a winding start turn, is positioned spaced from the flange part 11 at a certain distance.

It is apparent that the present invention is not limited to the above embodiments, but may be modified and changed without departing from the scope and spirit of the invention.

What is claimed is:

1. A coil component comprising:

a winding core part; and a wire wound around the winding core part, wherein an i-th turn (i is an integer equal to or larger than 1) to a j-th turn (j is an integer equal to or larger than (i+2)) of the wire are wound in this order around the winding core part in an aligned state, wherein a (j-th+1) turn of the wire is wound around a valley line formed by the i-th turn and a (i-th+1) turn, wherein a (j-th+2) turn of the wire is wound adjacent to the j-th turn around the winding core part, and wherein a (j-th+3) turn of the wire is wound along a valley line formed by a (j-th−1) turn and the j-th turn.

2. The coil component as claimed in claim 1, wherein a (j-th+2) turn to a (j-th+2k) turn (k is a variable starting from 2 and incremented by one) of the wire are wound in this order around the winding core part in an aligned state.

3. The coil component as claimed in claim 2, wherein a (j-th+2k+1) turn of the wire is wound along a valley line formed by a (j-th+2k−4) turn and a (j-th+2k −2) turn.

4. The coil component as claimed in claim 2, wherein a (j-th+3) turn of the wire is wound along a valley line formed by a (j-th−2) turn and a (j-th−1) turn.

5. The coil component as claimed in claim 4, wherein a (j-th+2k+3) turn of the wire is wound along a valley line formed by a (j-th+2k−4) turn and a (j-th+2k−2) turn.

6. The coil component as claimed in claim 5, wherein any of (j-th+2k+3) turns of the wire are not be wound along a valley line formed by a (j-th+2p) turn (p is an integer equal to or larger than 2) and a (j-th+2p+2) turn.

7. The coil component as claimed in claim 1, further comprising:

a flange part; and a terminal electrode provided on the flange part and connected with one end of the wire, wherein the i-th turn is a first turn with the terminal electrode as a winding start point.

8. The coil component as claimed in claim 1, wherein a (j-th+5) turn of the wire is wound along a valley line formed by the j-th turn and the (j-th+2) turn.

9. The coil component as claimed in claim 8, wherein a (j-th+4) turn of the wire is wound adjacent to the (j-th+2) turn around the winding core part, and wherein a (j-th+7) turn of the wire is wound along a valley line formed by a (j-th+2) turn and the (j-th+4) turn.

10. A coil component comprising:

a winding core part;

a flange part;

a terminal electrode provided on the flange part; and a wire wound around the winding core part, wherein one end of the wire is connected to the terminal electrode, wherein the wire has first, second, third, fourth, fifth and sixth turns counting from the one end, wherein the first, second, third, and fifth turns are wound in this order around the winding core part in an aligned state, wherein the fourth turn is wound around a valley line formed by the first and second turns, and wherein the sixth turn is wound around a valley line formed by the second and third turns.

11. The coil component as claimed in claim 10, wherein the wire further has a seventh turn counting from the one end, and wherein the seventh turn is wound adjacent to the fifth turn around the winding core part.

12. The coil component as claimed in claim 11, wherein the wire further has an eighth turn counting from the one end, and wherein the eighth turn is wound around a valley line formed by the third and fifth turns.

13. The coil component as claimed in claim 12, wherein the wire further has a ninth turn counting from the one end, and wherein the ninth turn is wound adjacent to the seventh turn around the winding core part.

14. The coil component as claimed in claim 13, wherein the wire further has a tenth turn counting from the one end, and wherein the tenth turn is wound around a valley line formed by the fifth and seventh turns.

* * * * *